United States Patent [19]

Nichols

[11] Patent Number: 4,652,022

[45] Date of Patent: Mar. 24, 1987

[54] WELLHEAD EQUIPMENT SUPPORT

[75] Inventor: Randy P. Nichols, Humble, Tex.

[73] Assignee: Cactus Wellhead Equipment Co., Inc., Houston, Tex.

[21] Appl. No.: 654,352

[22] Filed: Sep. 25, 1984

[51] Int. Cl.[4] ..... F16J 15/00

[52] U.S. Cl. ..... 285/92; 285/140; 285/393

[58] Field of Search ..... 285/140, 141, 142, 143, 285/393, 356, 81, 138, 323, 92; 166/75.1, 208

[56] References Cited

U.S. PATENT DOCUMENTS

| | | | |
|---|---|---|---|
| 2,916,306 | 12/1959 | Rickard | 285/393 |
| 3,361,453 | 1/1968 | Brown et al. | 285/356 |
| 3,871,449 | 3/1975 | Ahlstone | 285/140 |
| 3,973,792 | 8/1976 | Gönner | 285/356 |
| 4,390,186 | 6/1983 | McGee et al. | 166/195 |
| 4,407,530 | 10/1983 | Fowler | 285/140 |
| 4,473,230 | 9/1984 | Adamek | 285/140 |

*Primary Examiner*—Richard J. Scanlan, Jr.
*Assistant Examiner*—Anthony Knight
*Attorney, Agent, or Firm*—Flanagan, III: Eugene L.

[57] ABSTRACT

A suspension nut for use in a wellhead assembly of an oil and/or gas well is provided. The nut includes a lower body portion threaded for connection to the wellhead assembly. It also includes an upper body portion adapted to support equipment in the well. The upper body portion is spaced from a surface of the wellhead assembly in the absence of force applied thereto when the lower body portion is connected to the wellhead assembly. The upper body portion is adapted to be forced into abutment with the surface in reaction to the weight of equipment supported by the upper body portion.

5 Claims, 3 Drawing Figures

WELLHEAD EQUIPMENT SUPPORT

BACKGROUND OF THE INVENTION

The present invention relates to improved devices for supporting equipment in a well, such as an oil or gas well.

In prior art wellhead arrangements, it is known to suspend tubing from a coupling, which in turn is supported on an inwardly facing, frusto-conical surface of a suspension nut. The frusto-conical surface is positioned radially inwardly of and axially aligned with an outer threaded surface of the nut, which is made up on the threads of a tubing head adapter at the wellhead. The threads fit closely together; accordingly, the suspension nut is made relatively thick, ensuring that it will not expand significantly outwardly.

The threads of the suspension nut are required to support the tubing when it is reciprocated upwardly from the tubing head (for example, to pull out of a packer). Also, it often happens in many wellhead assemblies that the threads alone must support the nut and the tubing string, even when it is not being reciprocated. If the nut backs out, this will result in dropping a tubing string which typically is several thousand feet long, with potentially significant damage. It can also result in loss of control over downhole pressures. However, because the suspension nut is enclosed between the tubing and the tubing head adapter, it is difficult to utilize conventional means, such as a set screw, to prevent the threads from backing out.

SUMMARY

In accordance with one aspect of the present invention, a wellhead assembly for supporting equipment in a well, such as an oil and/or gas well, is provided. The assembly includes a suspension nut having a threaded outer surface and a wellhead member having an inner threaded surface adapted to mesh with the threaded outer surface of the suspension nut. The suspension nut has a projection extending axially from its threaded outer surface and having an inner surface adapted to support equipment in the well such that force exerted by the weight of the equipment against the inner surface is transformed at least in part to a radially outwardly directed force. In accordance with a preferred embodiment, the projection has an outer surface sized such that it is spaced from an inner surface of the wellhead member in the absence of force exerted against the inner surface of the projection and is adapted to be deflected outwardly by the application of force to the inner surface such that its outer surface abuts the inner surface of the wellhead member. Accordingly, when equipment contacts the inner surface of the projection such that the equipment is suspended in the well, the force exerted outwardly against the projection forces it against the inner surface of the wellhead member thus to produce a frictional force resisting backing-off of the suspension nut from the wellhead assembly.

In accordance with a further aspect of the preferred embodiment, the outer surface of the projection of the suspension nut is sized such that, when the projection is deflected outwardly against the inner surface of the wellhead member by force exerted against the inner surface of the projection, the projection is deflected elastically. Therefore, the projection will assume its original, undeflected configuration when force is removed from its inner surface. This renders it relatively easy to then remove the suspension nut from the wellhead assembly, when desired.

In accordance with yet another advantageous aspect of the present invention, a suspension nut for use in a wellhead assembly is provided. The suspension nut comprises a lower body portion threaded for connection to the wellhead assembly and an upper body portion adapted to support equipment in the well. The upper body portion is spaced from a surface of the wellhead assembly in the absence of force applied thereto when the lower body portion is connected to the wellhead assembly and adapted to be forced into abutment with the surface in reaction to the weight of equipment supported by the upper body portion. In accordance with a preferred embodiment, the upper body portion is adapted to be deflected from an original unstressed position to a stressed position in abutment with the surface in reaction to the weight of the supported equipment, and is sized such that its elastic limit is not exceeded when in the stressed position.

BRIEF DESCRIPTION OF DRAWINGS

The present invention, as well as further objects and features thereof, will be understood more clearly and fully from the following description of certain preferred embodiments when read with reference to the accompanying drawings, wherein.

DETAILED DESCRIPTION OF CERTAIN PREFERRED EMBODIMENTS

Figure 1:
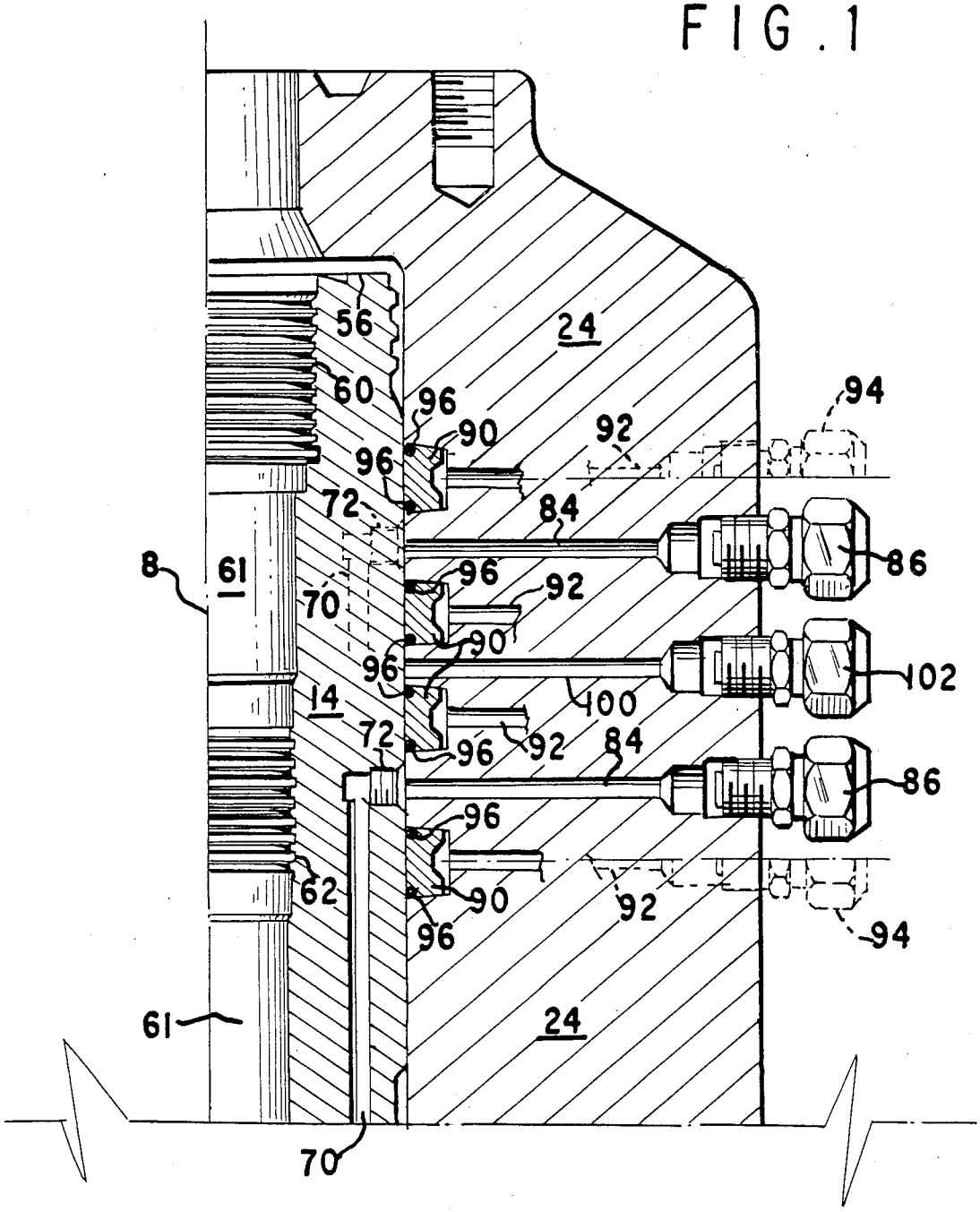
FIGS. 1, 2 and 3 are partial cross-sectional views of contiguous portions of a wellhead assembly, incorporating the features of the present invention.

With reference to the drawings, a wellhead assembly for an oil and/or gas well is illustrated in cross section. Only that portion of the assembly to the right of the center line 8, is shown, the left hand portion thereof being identical to the right hand portion. A tubing head 10 is immovably affixed to the wellhead (FIG. 2) and supports an annularly shaped pack-off device 12 which serves to provide a slidable seal against an outer surface 16 of a one-piece tubular body of a communication joint 14. The communication joint 14 is supported at the wellhead by an annular suspension nut 20, which in turn is coupled by a threaded connection to an adapter member 24; member 24 serves to support the suspension nut 20 through the threaded connection.

The tubing head 10 may be, for example, a Type C tubing spool; the pack-off 12 may be, for example, a Type C tubing hanger; and the adapter 24 may, for example, be a Type CSJ adapter, all sold by GEO Cactus Wellhead Equipment Company, Houston, Tex., United States of America.

Figure 2:
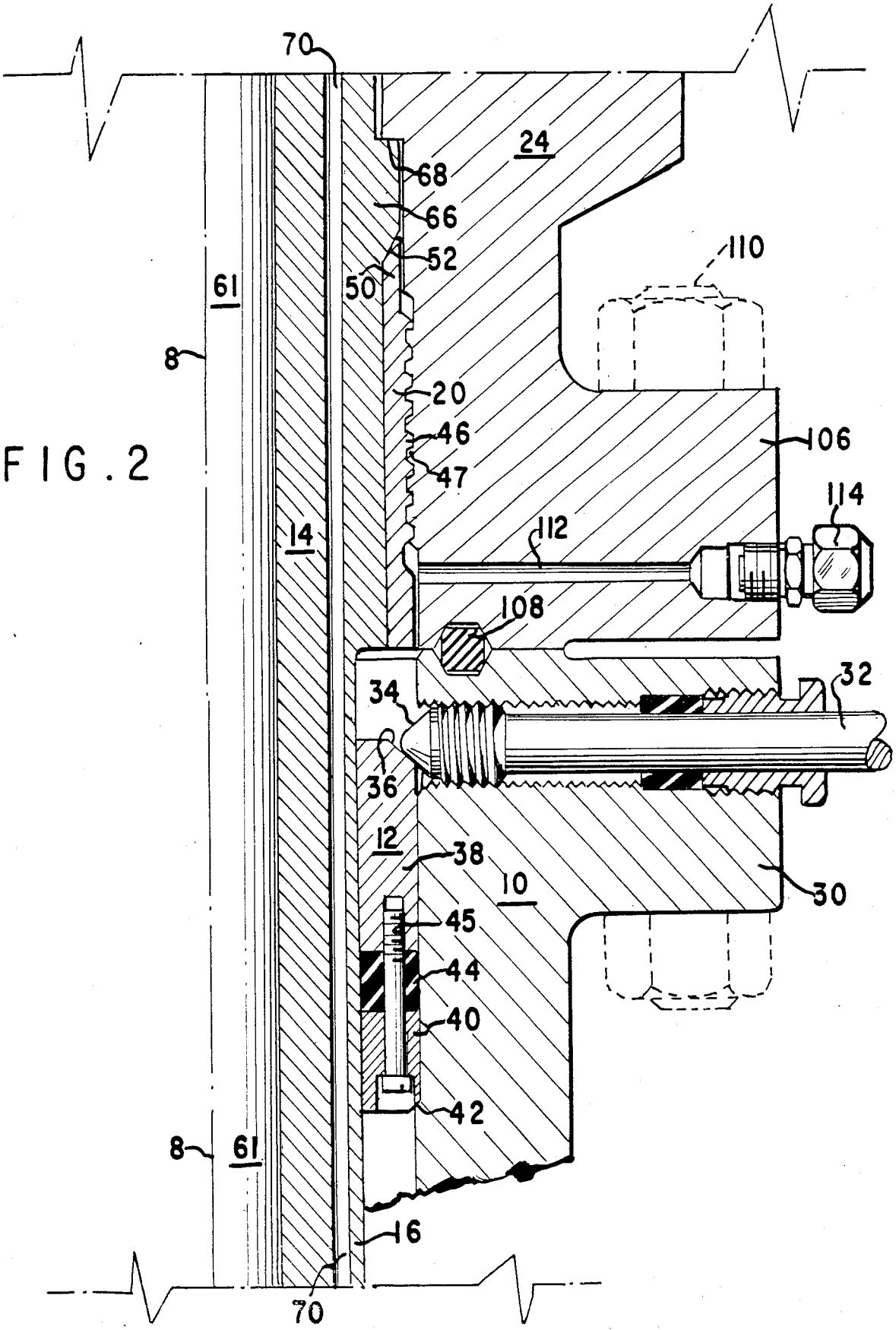

With reference to FIG. 2, the tubing head 10 includes a radially outwardly extending flange 30 having a radial bore extending therethrough and into which is threaded a conventional lock screw 32 having a generally conically shaped, inwardly extending end 34 shown abutting a cam surface 36 of an upper annular portion 38 of the pack-off 12. The pack-off 12 also includes a lower annular portion 40 supported in a shoulder 42 of the tubing head 10, and an elastomeric seal ring 44 compressed between the upper and lower portions 38 and 40 of the pack-off 12. A number of bolts 45 serve to maintain the various elements of the pack-off 12 together. When the lock screw 32 is advanced inwardly, the inner end 34 thereof forces the upper portion 38 of pack-off 12 downwardly, thus to compress the seal ring 44 against the lower portion 40, to thereby form a seal against the outer surface 16 of the body of the communication joint 14.

The suspension nut 20 is provided with threads 46 on its outer surface intermediate of the ends of the suspension nut 20. Threads 46 are enmeshed with opposing threads 47 on an inner surface of adapter 24. Extending upwardly from the threaded portion of the suspension nut 20 is an annular projection 50 having an inwardly facing, frusto-conical surface 52 extending inwardly and downwardly from the upper extremity of projection 50 and forming an angle with the central axis of the suspension nut 20 of 30°. The outer diameter of the projection 50 is selected so that when the expansion nut 20 is threaded into the adapter 24 and in the absence of force exerted against the surface 52, the outer surface of the projection 50 is spaced slightly from the opposing inner surface of the adapter 24. Moreover, the spacing between the outer surface of the projection 50 and the inner surface of the adapter 24 is selected so that when the projection 50 is deflected outwardly as force is applied to the surface 52, its elastic limit will not be exceeded before it abuts the inner surface of adapter 24. Accordingly, when the load is removed from the surface 52, the projection 50 will assume its original shape, permitting the suspension nut 20 to be removed from the adapter 24 easily by reversing out the threads 46. The annular thickness of the projection 50 is selected so that under normal load conditions, as described herein below, the projection 50 will be displaced outwardly sufficiently to contact the inner surface of the adapter 24. Since the outer surface of the projection 50 is thereby forced against the inner surface of the adapter 24, a frictional force is produced thereby tending to prevent the suspension nut 20 from backing out of the adapter 24.

As noted hereinabove, the communication joint 14 is comprised of a one-piece tubular body, preferably fabricated from a single piece of material. The tubular body extends from an upper end 56 received within the adapter 24, to a lower end 58 (FIG. 3) provided with a pin type threaded coupling from which a tubing string suspended in the well is supported. Accordingly, the communication joint 14 serves, in part, as a tubing hanger. The upper end 56 of the one-piece body is provided with a pin type coupling 60 which permits a joint of tubing to be attached thereto in order to lift the communication joint (and the suspended tubing string) to permit the tubing string to be reciprocated in the well for various purposes, such as stabbing into or pulling out of a permanent packer downhole. While the communication joint and suspended tubing are thus either being lifted or lowered from or into the well, the seal 44 maintains control at the wellhead of fluid pressure outside the communication joint 14 in the well. Accordingly, the seal provided by the seal ring 44 against the surface 16 is a sliding seal.

The communication joint 14 is provided with a central bore 61 in communication with the tubing suspended therefrom and provides a fluid passageway for conducting production fluids, well stimulation fluids and the like between the wellhead and the tubing. In order to maintain control over tubing pressure, a further set of threads 62 are provided on the inner surface of the body of the communication joint 14 to permit a plug to be set therein thus to isolate fluid pressure in the tubing therebelow from the wellhead. This may be desirable, for example, when the tubing is being reciprocated into or from the well by manipulation of the communication joint 14, in order to maintain control of pressures within the tubing.

The body of the communication joint 14 is provided with a flange 66 extending from an upwardly facing shoulder 68 abutting a corresponding, downwardly facing shoulder of the adapter 24, to a lower, frusto-conical surface parallel with an abutting surface 52 on the suspension nut 20, whereby the communication joint 14 and the tubing string suspended therefrom are supported. In this manner, the weight of the communication joint 14 and the tubing supported thereby is exerted against the surface 52 of the suspension nut 20, thus to deflect its upper projection 50 outwardly, as discussed above.

Figure 3:
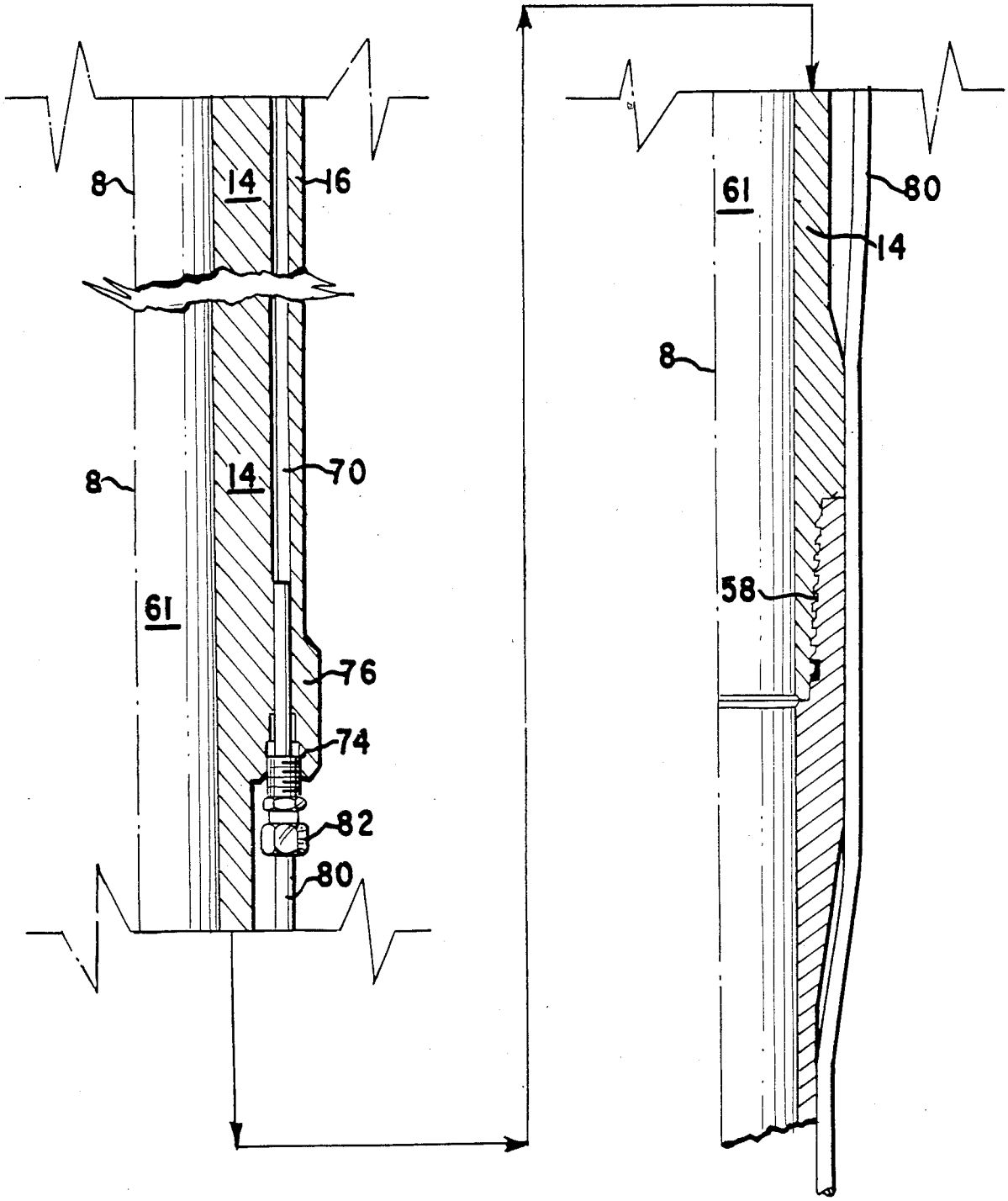

In order to provide additional fluid communication paths from the wellhead downwardly past the seal 44, or in the alternative, to provide electrical communication between the wellhead and the interior of the well, a plurality of conduits 70 are formed in the one-piece body of the communication joint 14 and extend within that body from respective upper ports 72 formed between the conduits 70 and the outer surface of the one-piece body, to a second set of lower ports 74 formed in a downwardly facing annular surface of a lower flanged portion 76 adjacent the lower end 58 of the communication joint 14. In the embodiment of FIGS. 1–3, the conduits 70 serve to communicate fluid under pressure from the wellhead downwardly past the seal 44 to respective subsurface lines 80 in fluid communication with the conduits 70 through fluid couplings 82 threaded to the ports 74. The lines 80 extend downhole to one or more tools or instruments, such as subsurface control valves or pressure measuring instruments, either to provide fluid under pressure for operating such tools or to provide fluid communication with downhole instruments.

The conduits 70 may be formed in the one-piece body of the communication joint 14 by any of a variety of methods. For example, each conduit 70 may be drilled through the one-piece body. In the alternative, each conduit 70 may be formed by milling an axially extending groove in the outer surface 16 of the communication joint 14, positioning a tubing, for example, of the same type as tubing 80, along the extent of the groove and then welding an insert into the exterior of the groove so that it is then integral with the body of the communication joint 14.

The adapter 24 provides means for establishing fluid communication with the conduits 70, while isolating the fluid pressure in each conduit 70 from the other conduits 70. In particular, the adapter 24 is provided with a plurality of ports 84 each in fluid communication with a respective conduit 70 through its port 72. Each of the ports 84 is provided with a threaded coupling adjacent an outer surface of the adapter 24 in which is threaded a respective check valve 86, which may, for example, be a Type K device sold by GEO Cactus Wellhead Equipment Company, Houston, Tex., United States of America. Each of the check valves 86 is adapted upon rotation to the desired position thereof to either seal off the port 84 completely, or merely act as a check valve.

The adapter 24 is provided with a number of elastomeric seals 90 spaced axially along its inside diameter and serving to isolate each of the ports 72 and the corresponding conduit 70 from the other ports 72 and conduits 70 at the wellhead. Each of the elastomeric seals 90 is coupled through a respective port 92 with the exterior of the adapter 24 through a respective additional check valve 94 of the same type as the check valves 86. The elastomeric seals 90 are of the type which is energized by the injection of plastic through the check valves 94 and the ports 92 to press inwardly against an outer surface of the elastomeric seal 90. In order to prevent the seals 90 from extruding axially between the outer surface of the communication joint 14 and the inner surface of the adapter 24, each seal 90 is provided with two non-extrusion rings 96 one positioned at the upper, inner extremity of the seal 90 and the other positioned at the lower, inner extremity of the seal 90. A test port 100 is formed in the adapter 24 extending from the outer surface thereof to its inner surface between two of the seals 90 and having a threaded coupling at its outer extremity receiving yet another check valve 102 of the same type as the check valves 86 and providing a means of pressure testing the integrity of the seals 90 on either side thereof.

When the communication joint 14 is at its lowermost position, a lower flange 106 of the adapter 24 is sealed against the flange 30 of the tubing head 10 by a standard API-Type seal ring 108 captured in opposed grooves formed in the flanges 30 and 106. The adapter 24 is then coupled to the tubing head 10 by means of a plurality of bolts 110 joining the flange 30 to the flange 106 and exerting a compessive force thereagainst to maintain the fluid-tight seal against the ring 108. The integrity of this seal can be pressure tested by the application of fluid pressure through a test port 112 formed in flange 106 and closed by a further check valve 114.

Certain advantages of the present invention reside in the use of a suspension nut having an upward extension to which is applied the weight of the communication joint and the suspended tubing therebelow. By providing an extension of this type and spaced from the inner wall of the adapter or other structure surrounding the extension, the extension may be forced outwardly against the inner surface of the adapter or other structure thus to provide frictional resistance against the inadvertent decoupling or backing-off of the suspension nut from the structure to which it is threaded. In prior art suspension nuts which omit such an extension, the load bearing surface is positioned opposite the threaded portion of the nut so that the frictional restraint or locking feature provided by the extension in the suspension nut of the present invention is not so readily achieved. Since the spacing between the extension and the interior surface of the supporting structure is selected so that the extension is not forced past its elastic limit, it readily resumes its original shape when the load is removed therefrom, thus permitting the suspension nut to be easily removed from its supporting structure.

I claim:

1. A wellhead assembly for supporting equipment in a well, comprising:

a suspension nut having a threaded outer surface;

a wellhead member having an inner threaded surface adapted to mesh with the threaded outer surface of the suspension nut;

the suspension nut having a projection extending axially from its threaded outer surface and having an inner surface adapted to support equipment in the well;

at least a portion of the inner surface for supporting said equipment facing both inwardly and upwardly such that force exerted by the weight of the equipment against the inner surface is transformed at least in part to a radially outwardly directed force;

the projecting having an outer surface sized such that the outer surface is spaced from an inner surface of the wellhead member in the absence of force exerted against the inner surface of the projection such that the projection is deflected outwardly by the force exerted by the weight of the equipment against said inner surface.

2. The wellhead assembly of claim 1, wherein the projection comprises elastically deformable material and the outer surface of the projection of the suspension nut is sized with respect to the inner surface of the wellhead member such that, when the projection is deflected outwardly against the inner surface of the wellhead member by force exerted against the inner surface of the projection, the projection is deflected to a maximum extent such that the elastic limit of said elastically deformable material is not exceeded, whereby the projection will assume its original, undeflected configuration when force is removed from its inner surface.

3. A suspension nut coupled to a wellhead assembly, comprising:

a first annularly shaped body portion threaded for connection to the wellhead assembly; and a second annularly shaped body portion spaced from a surface of the wellhead assembly and having an inner supporting surface adapted to support equipment in the well, the inner supporting surface being spaced axially from the first threaded body portion; at least a portion of the inner supporting surface facing both inwardly and upwardly such that force exerted by the weight of the equipment against the inner surface is transformed at least in part to a radially outwardly directed force whereby said second body portion is deflected into abutment with said wellhead surface.

4. The suspension nut of claim 3, wherein the second body portion is sized such that it is spaced from an opposing surface of the wellhead assembly when the first body portion is connected thereto and in the absence of force applied to the inner supporting surface, such that the second body portion is deflected outwardly by the application of force to its inner supporting surface, and against an inner surface of the wellhead assembly.

5. The suspension nut of claim 3, wherein the second body portion comprises elastically deformable material and is sized with respect to the surface of the wellhead assembly such that, when the second body portion is forced into abutment with the surface of the wellhead assembly, the elastic limit of said elastically deformable material comprising the second body portion is not exceeded.

* * * * *